US007187626B2

(12) United States Patent
Lizzi

(10) Patent No.: US 7,187,626 B2
(45) **Date of Patent: *Mar. 6, 2007**

(54) METHOD AND APPARATUS FOR TRACKING USAGE OF A MULTI-FUNCTIONAL ELECTRONIC DEVICE

(75) Inventor: Ronald S. Lizzi, West Hartford, CT (US)

(73) Assignee: Timex Group B.V. (NL)

( * ) Notice: Subject to any disclaimer, the term of this patent is extended or adjusted under 35 U.S.C. 154(b) by 90 days.

This patent is subject to a terminal disclaimer.

(21) Appl. No.: 10/873,827

(22) Filed: Jun. 22, 2004

(65) Prior Publication Data

US 2004/0223414 A1 Nov. 11, 2004

Related U.S. Application Data

(63) Continuation of application No. 09/660,781, filed on Sep. 13, 2000, now Pat. No. 6,781,923.

(51) Int. Cl.
*G04F 10/00* (2006.01)

(52) U.S. Cl. ..... 368/107; 368/327

(58) Field of Classification Search ..... 368/107, 368/184, 3, 10, 15, 111, 221, 327
See application file for complete search history.

(56) References Cited

U.S. PATENT DOCUMENTS 3,890,490 A 6/1975 Buenger
4,093,992 A * 6/1978 Kawamura et al. ..... 78/111
4,168,525 A 9/1979 Russell
4,283,784 A 8/1981 Horan
4,375,080 A 2/1983 Barry et al.
4,518,267 A 5/1985 Hepp
4,780,864 A 10/1988 Houlihan
4,783,773 A 11/1988 Houlihan et al.
4,924,418 A 5/1990 Bachman et al.
4,942,559 A 7/1990 Fleck et al.
4,989,188 A 1/1991 Thinesen
4,993,004 A 2/1991 Loizeaux
5,229,981 A 7/1993 Maschi
5,555,226 A 9/1996 Lizzi
5,724,260 A 3/1998 Klein
5,742,565 A 4/1998 Cuinet et al.
5,917,429 A 6/1999 Otis, Jr. et al.
5,923,870 A 7/1999 Johns et al.
6,075,755 A 6/2000 Zarchan
6,567,768 B1 5/2003 Matos et al.

* cited by examiner

*Primary Examiner*—Vit Miska
*Assistant Examiner*—Jeanne-Marguerite Goodwin
(74) *Attorney, Agent, or Firm*—Carmody & Torrance LLP

(57) ABSTRACT

A method for tracking total usage time of an electronic device comprising the steps of evaluating a predetermined usage increment timer until a predetermined time period expires, incrementing a total-usage counter, resetting the timer to measure a next occurrence of the predetermined time period, repeating the aforementioned steps and outputting the value representing the total usage time of the device. A multi-mode electronic device that carries out the aforementioned method is also provided. Still further, the present invention provides a method of and device for tracking total usage time or number of activations of any feature or mode within the device.

19 Claims, 6 Drawing Sheets

| SWITCHING MECHANISMS | COUNTERS |
|---|---|
| P1 | $C_{SM1}$ |
| P2 | $C_{SM2}$ |
| P3 | $C_{SM3}$ |
| P4 | $C_{SM4}$ |
| | |
| | |

200

202

*FIG. 4A*

| STATE/MODE | COUNTERS |
|---|---|
| INFORMATION SETTING STATE | $C_{ST1}$ |
| MODE SETTING STATE | $C_{ST2}$ |
| TOD MODE | $C_{ST3}$ |
| CHRONO MODE | $C_{ST4}$ |
| TIMER MODE | $C_{ST5}$ |
| ALARM MODE | $C_{ST6}$ |
| T2 MODE | $C_{ST7}$ |
| TRACEABILITY MODE | $C_{ST8}$ |
| | |
| | |

300

302

*FIG. 4B*

METHOD AND APPARATUS FOR TRACKING USAGE OF A MULTI-FUNCTIONAL ELECTRONIC DEVICE

CROSS REFERENCE TO RELATED APPLICATION

This application is a continuation of prior application Ser. No. 09/660,781, filed Sep. 13, 2000, now U.S. Pat. No. 6,781,923.

BACKGROUND OF THE INVENTION

The present invention relates generally to multi-mode, multi-functional electronic devices and, more particularly, to an improved method and construction for tracking the total usage time of such a device and for tracking the usage of features and components of such a multi-mode, multi-functional electronic device such as an electronic timepiece.

Multi-mode, multi-functional electronic devices having manually activated switches and an integrated circuit programmed to invoke predefined features in response to the activation of at least one of the manually activated switches are well known. For example, multi-mode electronic timepieces are known which include a dial or display, manually activatable switches (referred to as crowns or pushers), and an integrated circuit. The electronic timepiece may have multiple operating modes. For example, in a digital, multi-mode, electronic timepiece, the operating modes may include a time-of-day (TOD) mode, a chronograph (CHRONO) mode, an alarm setting (ALARM) mode, a countdown timer (TIMER) mode, and an alternate time zone (T2) mode. Generally, one of the pushers is activated to change from one operating mode to another. Another one or more of the pushers may be activated during setting functions to change information being exhibited during a currently activated operating mode.

Examples of such multi-mode, multi-functional electronic timepieces include commonly assigned, U.S. Pat. No. 5,742,565, issued Apr. 21, 1998 to Cuinet et al.; U.S. Pat. No. 4,989,188 issued Jan. 01, 1991 to Thinesen; U.S. Pat. No. 4,783,773 issued Nov. 8, 1988 to Houlihan et al.; U.S. Pat. No. 4,780,864 issued Oct. 25, 1988 to Houlihan; and U.S. Pat. No. 4,283,784 issued Aug. 11, 1981 to Horan. Exemplary setting functions for the multi-mode electronic timepieces are described in commonly assigned, U.S. Pat. No. 5,555,226, issued Sep. 10, 1996 to Lizzi. The disclosure of these commonly assigned, U.S. Pat. Nos. 5,742,565, 4,989,188, 4,783,773, 4,780,864, 4,283,784 and 5,555,226 are incorporated by reference as if fully set forth herein.

As the number of available operating modes and information to be exhibited and set increases, there may likewise be an increase in the desired number of pushers or sequencing thereof to activate the modes and/or to set the information exhibited therein. Further, the increasing number of modes and/or pushers may result in numerous procedural steps to set the information exhibited within the modes of the electronic device.

As can be appreciated, the numerous procedural steps increase the complexity of use and wear on particular components of the electronic device. It follows that it becomes increasingly difficult to maintain simplicity in the device's functioning or sequencing.

Also, it would be advantageous to accumulate information on how consumers use the electronic devices. Firstly, it would be desirable to know the total time the device has been in use by the user. Such time period, by way of example, may start when the user first puts the device to use, may be when the user puts in batteries (if applicable) or may begin when the user activates certain button(s) in a particular sequence for the first time. Thereafter or simultaneously therewith, it would be desirable to know how often various features or functions of the electronic device are used to estimate, for example, the value of the feature to operators of the device. Additionally, it would be desirable to know how often various mechanical components of the device are used to predict, for example, the wear on the components and/or to determine their life. This information, in combination with knowing the actual total usage time of the device, can provide valuable information on the manner of use of the device itself. Such predictions may also permit the determination of the life of the power supply (i.e. a battery) of the device. It would also be advantageous to accumulate data to allow designers, for example, to simplify the operation of the device.

The inventor of the present invention has realized that currently there is no reliable way to achieve the aforementioned and below identified objectives.

Therefore, the present invention provides a construction and a method for reliably determining the usage of various features and/or mechanical components of an electronic device and the total usage time of the device itself, such as for a multi-mode, multi-functional electronic timepiece, without relying upon oral or written operator feedback. In this way, among other things, estimates of the frequency of use and predicted wear on component parts or the device itself may be improved.

OBJECTS AND ADVANTAGES OF THE INVENTION

Therefore, it is an object and advantage of this invention to provide a more reliable construction and method for determining the total usage time, or the usage of features and components of interest of an electronic device.

It is another object and advantage of this invention to provide a device construction and method of tracking total usage time of the device itself and of usage of features and components of an electronic device, such as a timepiece, to determine their value to customers, to predict wear and/or to estimate life of the device's energy source such as its battery.

It is still another object and advantage of this invention to provide a device construction and method of tracking total usage time of an electronic device, and usage of features and components of the electronic device, to store such tracking information, to selectively retrieve the stored tracking information and to exhibit the information on a display or to transmit the information to another device for further processing.

Further objects and advantages of this invention will become more apparent from a consideration of the drawings and ensuing description.

SUMMARY OF THE INVENTION

The foregoing and other problems are overcome and the objects and advantages are realized by an apparatus constructed in accordance with embodiments of this invention and by a method comprising the steps in accordance with the present invention, wherein an improved method and construction for tracking usage of a multi-mode electronic device is disclosed.

Generally speaking, in accordance with the present invention, a multi-mode electronic device having at least one manually activated switching mechanism and an integrated circuit operable in a plurality of modes, is provided. In accordance with one preferred embodiment, the electronic device comprises a detector for detecting an occurrence of a predetermined event, a counter for counting each of the detected occurrences, a storage device for storing a value representing an accumulation of each counted occurrence and an output device for selectively outputting the stored value. The output device may be a display device in or on the device itself. In another embodiment, the electronic device in accordance with the present invention preferably comprises a detector for detecting (a) manual activations of the at least one switching mechanism and (b) executions by the integrated circuit of at least one of the plurality of modes, a plurality of counters for counting each of the detected activations and of the detected executions, a storage device for storing an association of each of the plurality of counters to the at least one switching mechanism and to the at least one mode, the storage device further individually storing values representing an accumulation of the counted activations and executions, and an output device for selectively outputting the stored values.

In accordance with another aspect of the invention, a system for obtaining usage information in a multi-mode electronic device is provided. The system may comprise an electronic device comprising at least one manually activated switching mechanism and an integrated circuit operable in a plurality of modes, a detector for detecting (a) manual activations of the at least one switching mechanism and (b) executions by the integrated. circuit of at least one of the plurality of modes, a plurality of counters for counting each of the detected activations and of the detected executions, a storage device for storing an association of each of the plurality of counters to the at least one switching mechanism and to the at least one mode, the storage device further individually storing values representing an accumulation of the counted activations and executions, software and/or hardware for selectively outputting the stored values, and a display device, operatively coupleable to the electronic device, for receiving the stored values outputted by the electronic device. The system may include a host computer, and the electronic device transmits the stored values to the host computer, and further wherein the host computer can transmit the stored values to the display device. Similarly, the device may transmit the stored values to the host computer over a carrier.

The electronic device constructed in accordance with the present invention may also be constructed to store and track total usage time of the device. In this case, the device preferably comprises a switching mechanism and an integrated circuit, coupled to the switching mechanism, that (a) evaluates a predetermined usage increment timer until a predetermined time period expires, (b) increments a total-usage counter at the expiration of the usage increment timer; (c) resets the timer to measure a next occurrence of the predetermined time period and (d) preferably continues to repeat steps (a) through (c). The method, appreciating the objective of knowing the value (representative of the total usage of the device) stored in the total-usage counter, provides for outputting the value stored in the total-usage counter when a predetermined sequence is entered by the activation mechanism.

Similarly, a method for tracking information in a multi-mode electronic device of the type having at least one manually activated switching mechanism and an integrated circuit operable in a plurality of modes is provided. A preferred method comprises the steps of detecting manual activations of the at least one switching mechanism, and storing values representing the number of manual activations detected. The method may also include the step of outputting the stored values. Outputting the stored values may also comprise the additional step of selectively exhibiting the stored values on a display. The step of outputting may include the steps of operatively coupling the device to a host computer and transmitting selected ones of the stored values to the host computer. The method may also comprise the steps of detecting operative executions of at least one of the plurality of modes, storing a second value representing the detected operative executions of the at least one mode and outputting the second value. The outputting step may include exhibiting the second value on a display. Also, measuring a duration of time representing an operative execution of the at least one mode, storing a duration value representing the measured duration of time, and outputting the duration value is provided by the present invention.

Still further, a method in accordance with the present invention includes the steps of detecting an occurrence of at least one predetermined event within the device, counting each of the detected occurrences, and storing a value representing an accumulation of each counted occurrence. The stored values may be selectively outputted. The electronic device may further include a display and, when in a traceability mode, the method includes the additional step of outputting includes exhibiting the stored value on the display.

Lastly, provided herein is a method for tracking total usage time of an electronic device of the type having at least one activation mechanism and an integrated circuit for storing such usage time, the method comprising the steps of (a) evaluating a predetermined usage increment timer until a predetermined time period expires, (b) incrementing a total-usage counter, (c) resetting the timer to measure a next occurrence of the predetermined time period, (d) repeating steps (a) through (c), and if it is desired to know the value (representative of the total usage of the device) stored in the total-usage counter, provides for (e) outputting the value stored in the total-usage counter when a predetermined sequence is entered by the activation mechanism.

BRIEF DESCRIPTION OF THE DRAWINGS

The above set forth and other features of the invention are made more apparent in the ensuing Detailed Description of the Preferred Embodiments when read in conjunction with the attached Drawings, wherein:

FIGS. 4A and 4B illustrate tables for defining relationships between features and functions of a multi-mode, multi-functional device and devices for storing values representing the usage of the features and functions;

Identically labeled elements appearing in different ones of the above-described figures refer to the same elements but may not be referenced in the description for all figures.

DETAILED DESCRIPTION OF THE PREFERRED EMBODIMENT

Figure 1:
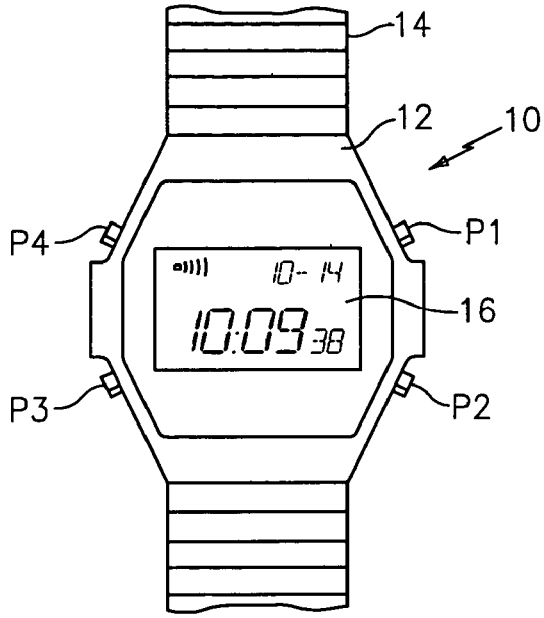
FIG. 1 is a simplified plan view of a multi-mode, multi-functional electronic device constructed in accordance with the present invention.

FIG. 1 illustrates but one example of a multi-mode, multi-functional electronic device constructed in accordance with the present invention such as, for example, a timepiece 10. The timepiece 10 includes a case 12 and a strap 14 for securing the timepiece 10 to a wrist of a wearer. The timepiece 10 also contains timekeeping circuitry (not shown) and a display 16. The timekeeping circuitry performs timekeeping functions of the timepiece 10. The display 16, typically a liquid crystal display (LCD), exhibits numbers, letters and symbols in accordance with known technology. The timekeeping functions of a typical electronic timepiece 10 are well known in the art, as is described in the above referenced U.S. Pat. Nos. 4,783,773, 4,780,864 and 4,283,784.

As shown in FIG. 1, the timepiece 10 includes manually activated switching mechanisms, for example, pushers P1–P4. The pushers P1–P4 may be selectively activated to cycle the timepiece 10 through multiple operating modes and setting states thereof such as, for example, a time-of-day (TOD) mode, a chronograph (CHRONO) mode, an alarm setting (ALARM) mode, a countdown timer (TIMER) mode, and even an alternate time zone (T2) mode. U.S. Pat. No. 5,555,226 describes operating modes and a SET subroutine for changing information exhibited on, for example, the display 16 of the timepiece 10. It should be understood, however that the present invention is equally applicable to other more recently developed technology owned by the present Assignee, such as that disclosed in copending application Ser. No. 09/359,223, the disclosure of which is incorporated by reference as if fully set forth herein. Accordingly, reference to the term "manually activated switching mechanism" should be interpreted broadly, as a "manually activated switching mechanism" can mean a push-button or a rotating bezel (if there are no external crown or pushers, for example) or may be a combination of both. That is, a rotating bezel alone, as contemplated herein, is sufficient to constitute a "manually activated switching mechanism" and would come within the scope of the claims presented herein.

Figure 2:
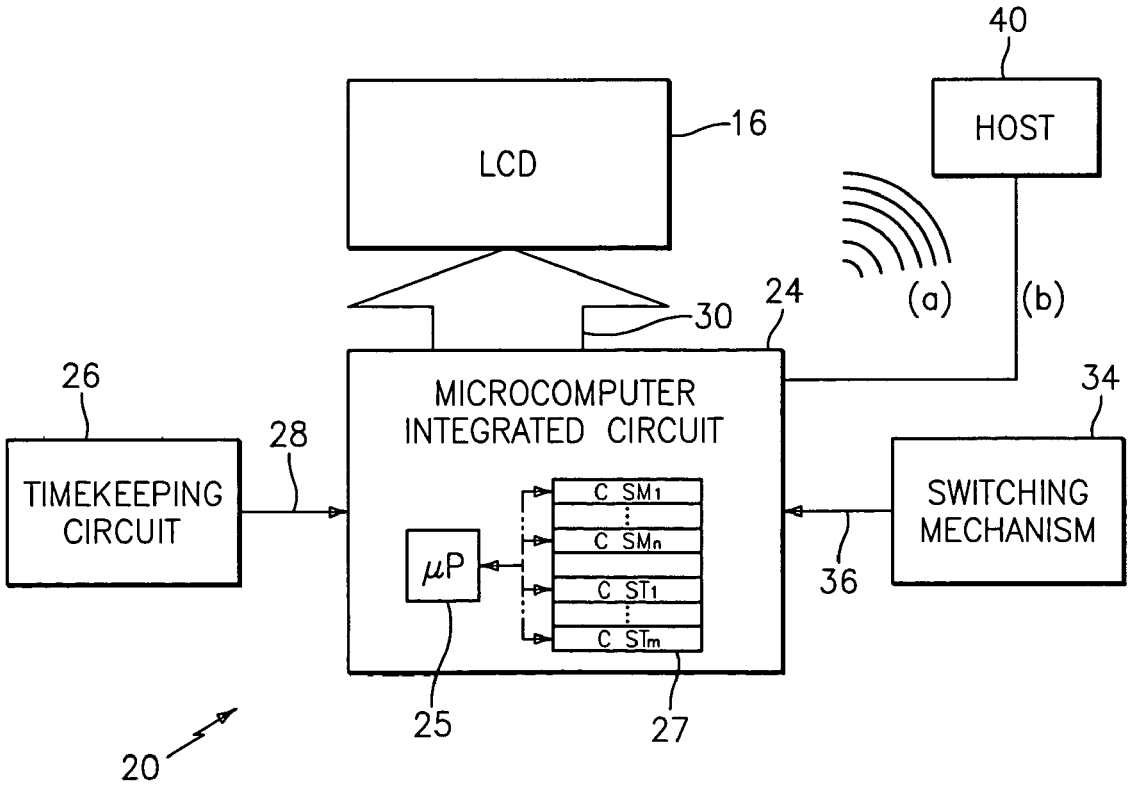
FIG. 2 is a block diagram of an integrated circuit and other components of the multi-mode, multi-functional electronic device of FIG. 1.

FIG. 2 illustrates a preferred embodiment of components of circuitry 20 of a multi-mode, multi-functional electronic device configured in accordance with the present invention, e.g., the timepiece 10. The circuitry 20 is disposed within the device and, in a preferred construction, is operable for performing timekeeping and other functions of the device. The circuitry 20 includes a programmable microcomputer 24 in the form of an integrated circuit chip, preferably bonded to a printed circuit board (not shown), a timekeeping circuit 26 and at least one switching mechanism, shown generally at 34. The term manually activated switching mechanism may include, for example, pushers (e.g. P1–P4 of FIG. 1), a crown affixed to a setting stem, a rotating ring, a slide switch, a roller ball or another similar device generally employed on electrical devices for activating various features thereof. Commonly-assigned and copending application Ser. No. 09/359,223, illustrates and describes use of such switching mechanisms in electronic devices such as the aforementioned electronic timepiece 10, and are contemplated herein.

The microcomputer 24 includes a microprocessor 25 and a memory device 27. The microprocessor 25 is programmed to perform instructions, in cooperation with the timekeeping circuit 26 and the switching mechanism 34, for achieving the timekeeping and other functions of the electronic device. The memory 27 may store, for example, data values and/or variables used by the microprocessor 25 in one or more operating modes of the device. In particular, the memory 27 stores usage-determining methodologies as software routines retrieved and executed by the microprocessor 25 in accordance with the present invention.

The timekeeping circuit 26 generates a time indicating signal 28 representing a time-of-day. The microcomputer 24 receives the time indicating signal 28 and, in at least one operating mode, processes the signal 28 to provide an output signal via a display bus 30 to a display such as, for example, the liquid crystal display (LCD) 16. The display 16 exhibits the time-of-day, other time measuring quantities, or other numbers, letters or symbols as instructed by the microcomputer 24. As is generally known, the display bus 30 represents several parallel leads to activate various segments of the display 16.

In accordance with the present invention, the memory 27 stores values representing the relative usage of each feature, function and/or component of the device and/or the total usage of the device away from a factory or retail sales environment. For example, a value representing the number of times a first switching mechanism (e.g., P1) is activated is stored in a counter $C_{SM1}$ within the memory 27. As the device may have 1 to n such switching mechanisms (e.g. P1–P4) represented by the switching mechanism 34, it should be appreciated that the memory 27 includes at least counters $C_{SM1}$ to $C_{SMn}$.

Similarly, the device may operate in 1 to m states and/or modes (e.g., an active mode state, a mode setting state, an information setting state, and the TOD mode, the CHRONO mode, and the T2 mode). Therefore, it should also be appreciated that the memory 27 may include at least counters $C_{ST1}$ to $C_{STm}$, wherein are stored values representing the usage of the various states/modes.

As recited herein, the usage of a state/mode may be the number of times the device enters the state/mode and/or operatively executes tasks within the state/mode. However, this is by way of example and not limitation, as the usage feature in accordance with the present invention may be tracking the duration that the device is operating within a particular state/mode and/or the total usage of the device. Additionally, it may be desirable to track the usage of various sub-modes of the timepiece. For example, it is within the scope of the present invention to maintain a counter that stores the number of times the date (i.e. day of the year) is set during the information setting state.

Figure 3:
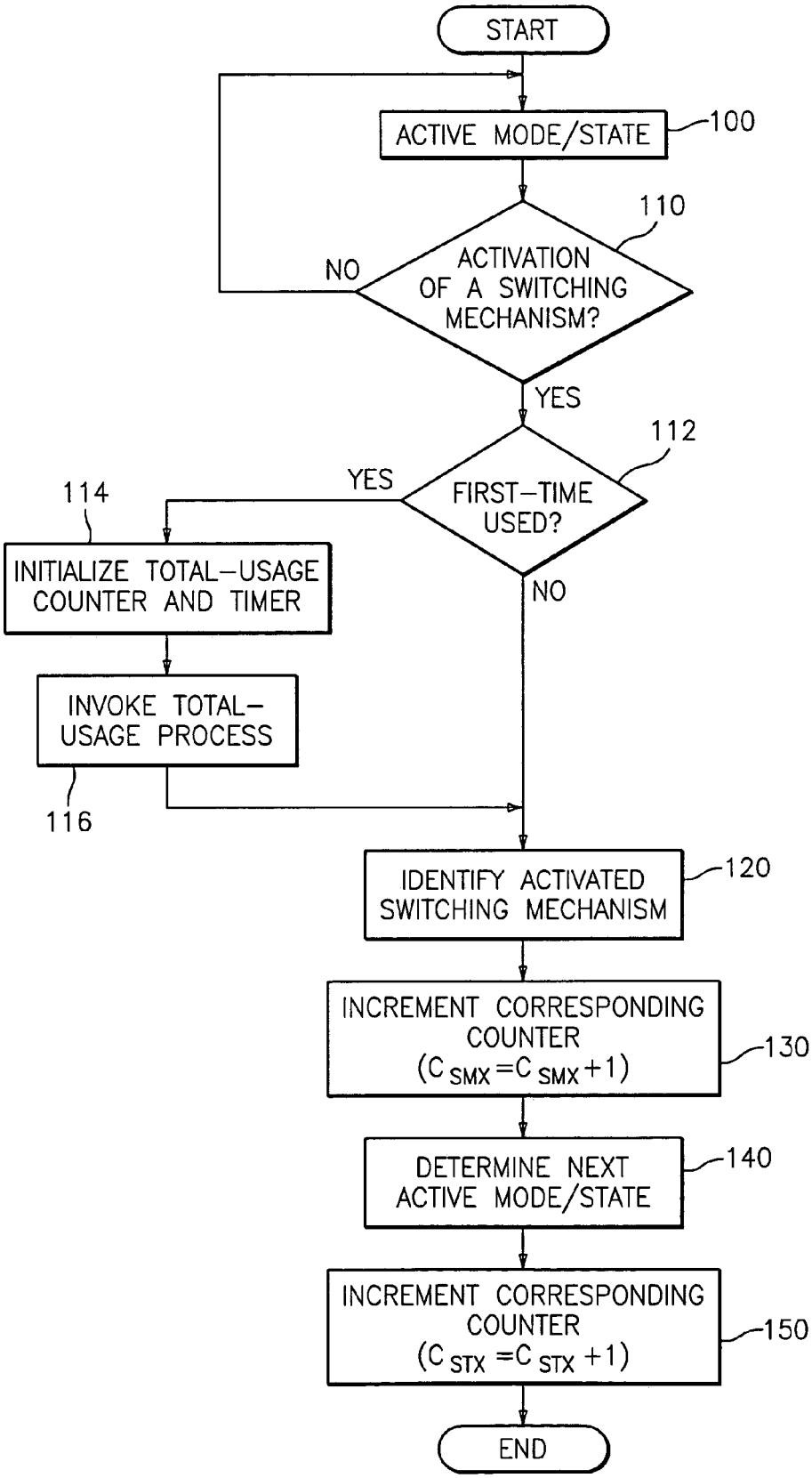
FIG. 3 illustrates a flow diagram of one embodiment of a usage methodology in accordance with the present invention.

With reference now to FIGS. 2 and 3, a preferred (but exemplary) operation of a multi-mode, multi-functional device, such as timepiece 10, is illustrated. At Block 100 the timepiece 10 operates within an active mode or state such as, for example, the TOD mode of the timepiece 10. At Block 110 the device remains in the active mode (by looping back to Block 100 along a "NO" path) until an occurrence of a predefined event such as the activation of one of the switching mechanisms, for example, the depression of P1. The activation of one of the switching mechanisms (represented in FIG. 2 as switching mechanism 34) generates a signal 36.

As is generally known, the microcomputer 24 receives the signal 36 and, in response thereto, activates a predetermined feature or function of the timepiece 10 such as, for example, signaling the entry into a next active mode or state of the device.

Figure 6:
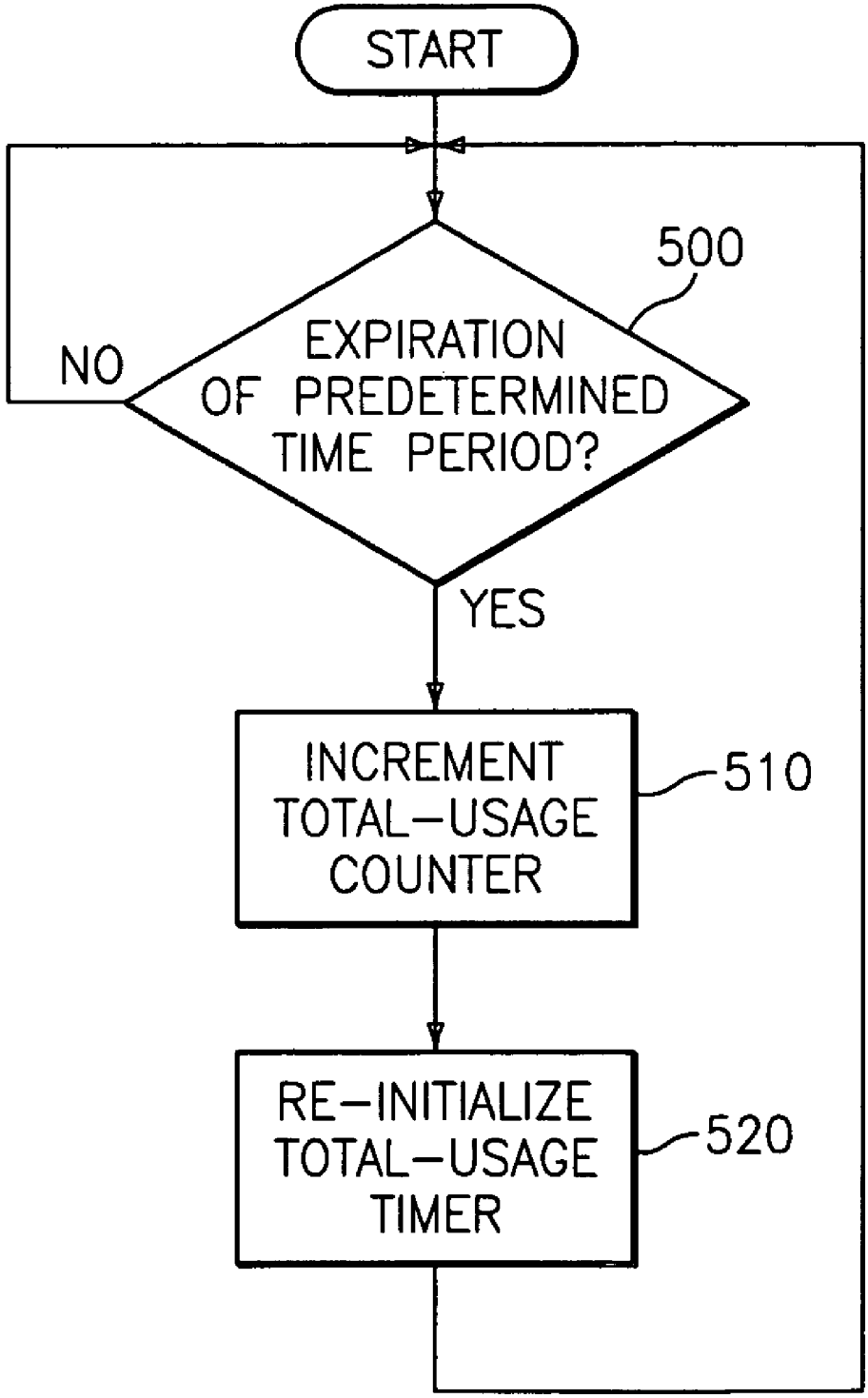
FIG. 6 illustrates a flow diagram of one embodiment of a total-usage process performed by an electronic device operating in accordance with the present invention.

As was described above, it is desirable to maintain an indication of the total usage of the electronic device. Therefore, in one embodiment, a logical flag or the like is maintained to identify a first-time use of the device outside the factory or retail environment. Accordingly, at Block 112, a "first-time used" flag is evaluated and if not set to an "on" value (i.e. if "on", the electronic device was already used outside the factory/retail environment) control passes along a "YES" path to Block 114. At Block 114, a total-usage counter, which stores a value representing the total usage of the device, is initialized (i.e. set to a zero value). Additionally, a total-usage timer is initialized at Block 114. The timer measures a predetermined duration of use, or more precisely, an expiration of a predetermined time period of, for example, a total number of days, hours, minutes and/or seconds, of use. In accordance with the present invention, once the total-usage timer expires the total-usage counter is incremented. The total-usage process, described in detail below with reference to FIG. 6, is invoked at Block 116 and continues until reset by, for example, a predefined software reset. In one embodiment, the software reset may be initiated upon activation of a predefined sequence of switching mechanisms.

Once the total-usage process is invoked, the "first-time used" flag is then set "on" to indicate that the device was, in fact, used. Control then passes to Block 120. Referring again to Block 112, if the first-time used flag was already "on", control passes along a "NO" path directly to Block 120.

In accordance with the present invention, the signal 36 also increments a counter (i.e. one of the counters $C_{SM1}$ to $C_{SMn}$) that corresponds to the activated switching mechanism. As it is preferable to independently track the activation of each of the switching mechanisms of the device, a process of evaluating each switching mechanism to determine the activated one thereof is desirable.

Accordingly, at Block 120, a process is invoked whereby each of the switching mechanisms is evaluated and the activated switching mechanism is detected. In one embodiment, for example, each switching mechanism generates a unique signal that is passed to the microcomputer 24 (each signal is shown in FIG. 2 collectively as signal 36). By monitoring each of the unique signals, activation of one of the switching mechanisms 34 can be detected. Once the activated switching mechanism is detected, a counter corresponding thereto is incremented.

In this regard, reference is made to FIG. 4A, where a selected portion of a table 200 is illustrated. Preferably, the table 200 is stored in the memory 27 and contains information representing an association between corresponding ones of the switching mechanisms 34 (e.g. P1–P4, and others) and the counters $C_{SM1}$–$C_{SMn}$. At Block 30, the microprocessor 25 accesses the table 200, identifies the entry corresponding to the activated switching mechanism (e.g. P1), retrieves an entry 202 of the table 200 that defines the relationship between the activated switching mechanism and its corresponding counter ($C_{SM1}$), and increments the counter accordingly ($C_{SM1}=C_{SM1}+1$).

As was discussed above, it is also within the scope of the present invention to track usage of the various modes and/or states of the device. Thus, upon activation of the switching mechanism, a counter associated with the next state or mode of the device is also incremented. That is, as the device exits the currently active mode/state (e.g. the TOD mode) and enters the next active mode/state (e.g. the TIMER mode), a counter corresponding to the next active mode/state is incremented. In this regard, reference is made to FIG. 4B, where a selected portion of a table 300 is illustrated. Preferably, the table 300 is stored in the memory 27 and contains information representing an association between corresponding ones of the states and/or modes of the electronic device and the counters $C_{ST1}$–$C_{STm}$.

At Block 140, a process is invoked wherein the next active mode/state of the timepiece 10 is identified. It should be appreciated that it is well known for electronic devices to operate within a predetermined sequence of modes/states and further, that the activation of a switching mechanism transitions the electronic device from a currently active mode/state to a next active mode/state. It follows, therefore, that the details of determining a next active mode/state are well known in the art and not discussed in further detail herein.

At Block 150, the microprocessor 25 accesses the table 300 and retrieves information (i.e. entry 302) that defines the relationship between the next active mode/state (e.g. the TIMER mode) and a corresponding counter (e.g. $C_{ST5}$). The corresponding counter ($C_{ST5}$) is then incremented ($C_{ST5}=C_{ST5}+1$)).

It should be appreciated that, in this exemplary embodiment, the activation of the switching mechanism, P1, resulted in the incrementing of two counters, one corresponding to the switching mechanism itself ($C_{SM1}$) and a second corresponding to the next active mode/state of the device ($C_{ST5}$).

In another aspect of the present invention, it is desirable to increment counters to represent the duration of a particular feature or function of the device. For example, a counter may be provided to determine the total number of seconds a backlight of the device illuminates a dial or a display, or the duration of time in which the device is in a particular state/mode. Similarly, another counter may include an indication of the total number of seconds an audible tone (i.e. an alarm) of the device is activated. As the duration of these and other functions are an important factor in determining the remaining life of the power source of the device, the values stored in the counters can be evaluated to predict a remaining useful life of the power source.

Figure 7:
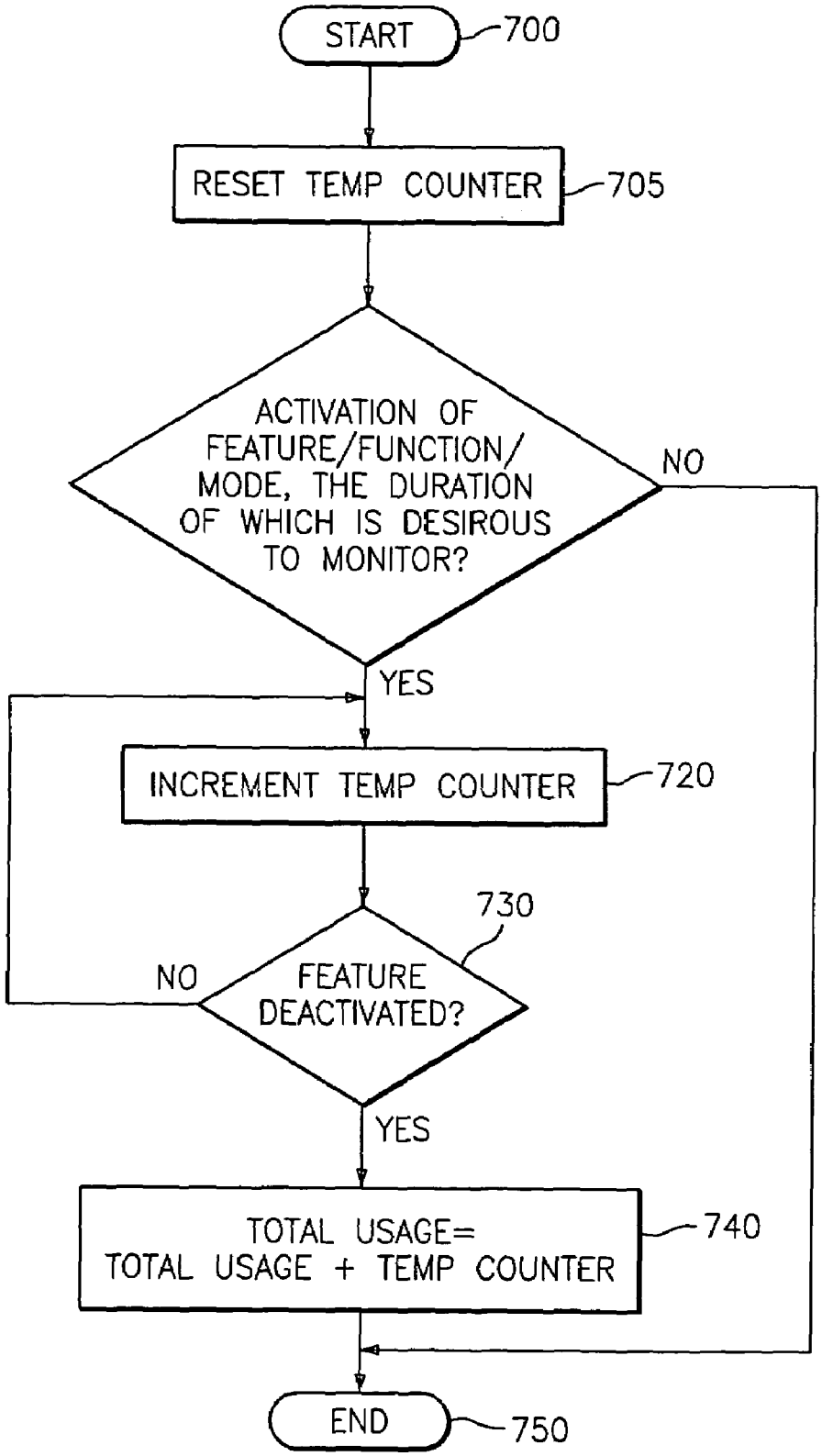
FIG. 7 illustrates a flow diagram of one embodiment of an exemplary feature/mode use duration timer operating in accordance with the present invention.

For example, with reference to FIG. 7, it is assumed that a particular feature has been activated or that a desired mode has been entered (see for example, Blocks 120 or Blocks 140 of FIG. 3) at the start of this routine (Block 700). At Block 705 a temporary counter (defined below) may be reset. Thereafter, it may be desirous at Block 710 to determine if the feature/mode is of a desired importance to monitor its total activation time (i.e. such as an alarm or a backlight). If it is, the control passes along a "YES" path to Block 720 where a Feature/Mode counter representing the total usage time during the particular usage event is stored. As it is determined at Block 730 if the feature or mode is deactivated, the total usage time for that feature or mode is incremented in a total usage counter (Block 740). The subroutine may thereafter end (Block 750). Each time the subroutine is entered, the total usage time of a feature or for which the device is in a particular mode can be maintained for later output on a display or transmitted to a separate output device, such as a host/central computer. With the above disclosure, it is well within the skill of the artisan to maintain separate counters for each particular feature or mode for which total time activation/usage is desired. It should also be understood that the incrementation of the temporary counter in this FIG. 7 can be achieved in a variety of ways, another of which for example can be by using duration countdown timers in combination with increment counters (see FIG. 6). All of the details should be well known to an artisan skilled in the present technology.

In another aspect of the invention, counters may store values representing the number of successful occurrences of a predefined feature or function of the device. For example, it is within the scope of the present invention to implement the usage determining methodologies disclosed herein within portable electronic device capable of receiving data downloaded (transmitted) from a host device. In one embodiment, therefore, counters may be maintained to indicate the total number of attempted download transactions and the number of successfully completed downloads. Such statistical tracking can be a useful aid in determining the reliability of present implementations of software routines within the portable electronic devices.

In the total usage tracking aspect of the invention discussed above, a counter may include a representation of the total usage of the device (i.e. the total-usage counter). The total-usage counter includes a number representing the total number of years, days, hours and/or minutes the device was operational, e.g. in use outside the factory and/or retail environment. Such total usage statistics may help in predicting or indicating the reliability of certain features of the device, or the device itself. Currently, such usage information may be unreliable as, generally speaking, such information can only be obtained from oral and/or written feedback provided by the purchasers of the device. Knowing such total usage time of the device itself may assist in providing a better understanding of the information derived from the other counters discussed above.

To this end, FIG. 6 illustrates a preferred (but exemplary) operation of the total-usage process. As was discussed above with reference to FIG. 3, the total-usage process is preferably invoked upon a first use of the electronic device out of the factory and/or retail sales environment. That is for example, when the electronic device is first put to its intended use by a purchaser of the device. Such a process could be invoked when the user first puts in batteries (if applicable) or may begin when the user activates certain button(s) in a particular sequence for the first time. These examples however, are just that examples, as it is recognized that other means or methodologies could be used to invoke the total-usage process. The important point to remember is that it is preferable (but not necessary) not to invoke the total-usage process until the device is put to use by the user, as opposed merely at the time the device is first activated i.e. within the store display case.

At Block 500, a predetermined usage increment is evaluated. Preferably, the predetermined usage increment is a predefined time period in which the manufacturer or designer of the device desires to track total usage. For example, the usage increment may be, for example, a day, a certain number of hours, or minutes or seconds, at which the usage of the device is to be indicated. As should be appreciated, the desired sensitivity to discrete usage may vary from application to application. That is, while reference is made to the expiration of a predetermined time period, other usage increments are contemplated such as, for example, determining total usage of the device by detecting a total number of times a predefined component of the device was activated.

At Block 500, an expiration of the usage increment (i.e. time period) is evaluated. The device continues to evaluate the time period (by looping back to Block 500 along a "NO" path) until the time period expires. Upon an expiration of the time period, control passes along a "YES". path to Block 510. At Block 510, the total-usage counter is incremented to measure the occurrence of another usage increment. Control then passes to Block 520 where the timer is reset to measure a next occurrence of the usage increment.

As noted above, once invoked, the total usage process continues throughout the life of the device or until the process is reset by a predefined event (i.e. the above-mentioned software reset).

In still another aspect of the present invention, the microcomputer 24 further operates in a traceability mode. In the traceability mode, selected switching mechanisms may be activated to output the contents of the usage counters discussed above, e.g. to exhibit on a display the stored values of the counters that represent the particular usage of the device and/or various features and functions of the device. Additionally, the traceability mode permits the selection of one or all of the counters so that the counter(s) may be initialized, i.e. reset to a zero value.

Figure 5:
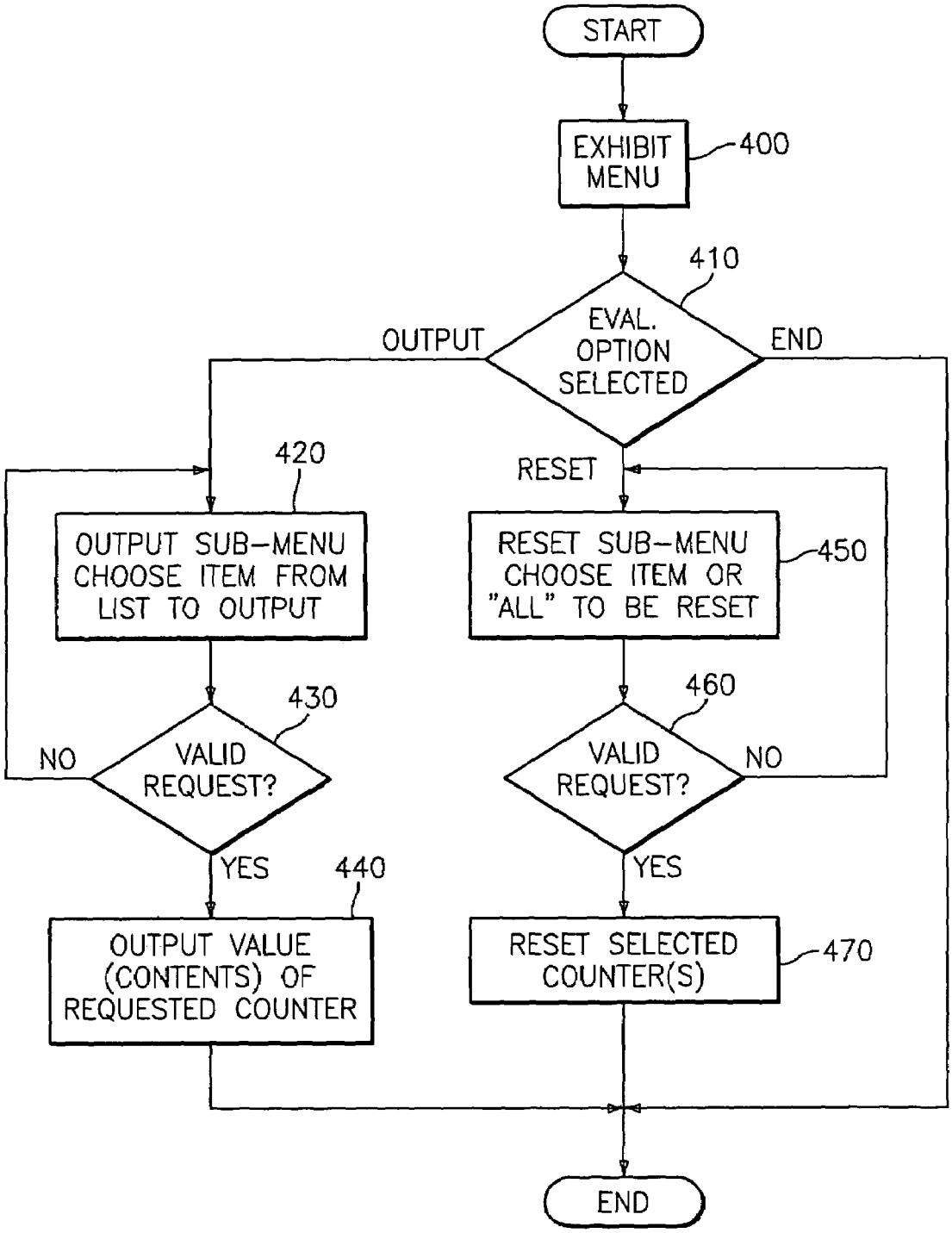
FIG. 5 illustrates a flow diagram of one embodiment of a traceability mode performed by an electronic device operating in accordance with the present invention.

FIG. 5 illustrates a preferred implementation of the traceability mode. At Block 400, a menu is exhibited on a display of the device, for example, on display 16. Preferably, the menu includes optional submenus within the traceability mode such as, for example, an output submenu and a reset submenu. The menu may also include a selection to terminate or end operation of the traceability mode and to return the device in a default or home state/mode. A desired option within the menu may be selected, for example, by manual manipulation of predefined switching mechanisms of the device. For example, P2 may be repeatedly depressed to cycle a cursor through the options on the menu and a second pusher, e.g. P3, may be depressed to select a highlighted one of the options.

At Block 410, the selected option is determined and control is passed along an appropriate path to perform the requested function. In the embodiment of FIG. 5, for example, control passes from Block 410 along one of an "Output" path, a "Reset" path or an "End" path. If the Output option is selected at Block 410, control passes from Block 410 to Block 420. At Block 420, the Output submenu is exhibited on the display 16. Preferably, the Output submenu includes an entry for each of the counters utilized to track usage of the features and functions of the timepiece, or the overall usage time of the device itself. To facilitate exhibition, a counter may be identified by a default name such as "Counter 1" or by a number, letter, abbreviated description, or symbol representative of the particular feature or function that it corresponds to. For example, a counter storing a value representative of the usage of the pusher P1 may be referred to as "P1" or "Pusher 1" or "$C_{SM1}$."

In one embodiment, illustrated in FIG. 5, control stays within the Output submenu until a valid entry is selected (control loops from a Block 430 back to Block 420 until a valid selection is made). At Block 440, the contents of the selected counter are outputted. In one embodiment, for example, the contents of the counter is exhibited on the display 16 and may be included within an informational message that includes the switching mechanism, mode or state that it represents as well as the contents of the counter. In another embodiment, wherein the electronic device may or may not include a display, the output step may include transmitting the contents of the counter to a peripheral device such as, for example, a printer for printing or host computer for exhibiting or otherwise processing the contents. Appreciating the objective of knowing the values stored in the respective counters, such as the total-usage counter (representative of the total usage of the device), the method provides for outputting the value stored in the total-usage counter when a predetermined sequence is entered by the activation mechanism. In accordance with the present invention, the total-usage time may continue to accumulate notwithstanding that there may be times during the life of the device that such information is extracted from the device.

Referring again to Block 410, control passes to Block 450 when a "Reset" option is selected. At Block 450 a Reset submenu is exhibited wherein, much like the Output submenu, an identifier representing each counter is exhibited. Additionally, a "select all" entry is exhibited. By selecting the "select all" entry, each counter within the device may be initialized, i.e. reset to a zero value. Preferably, selected ones or all of the counters may require the entry of an authorization code before the reset operation is performed. In some cases, for example, it may be desirable to prevent a user of the device from resetting a particular counter. For example, it is not desirable to permit the resetting of the total-usage counter once the device has left the factory and/or retail environment and been put to use.

At Block 460, selection of a valid request is verified. Preferably, at Block 460, the authorization routine is performed. If a valid request is made, and authorized, control passes to Block 470 where the actual initialization is performed on the selected counter(s).

It should be appreciated that the traceability mode may be invoked by a technician servicing or repairing the electronic device. Once retrieved, the usage information can then be communicated to the manufacturer and/or designers for statistical analysis consistent with the objects of the present invention.

Alternatively, the user of the electronic device may invoke the traceability mode and communicate the usage information directly to the manufacturer and/or designers. In one or more of these exemplary uses the communication step may include an electronic communication of the usage information to the manufacturer/designers over a communication network such as, for example, a global telecommunications network generally referred to as the Internet. To this end, the electronic device may include a data port whereby a physical connection or wireless communication link may be established between the electronic device and the communication network. As another example, in such a traceability mode, one may utilize a remotely located host computer, such as host computer 40 of FIG. 2. The connection between the device and host 40 may be physical, such as by cable shown broadly by option (b) in FIG. 2, or may be connected by modem, or may be an optical signal, an electrical signal, RF signal or otherwise so as to provide the communication link (see option (a) of FIG. 2) necessary to complete the system and achieve the method set forth herein.

Although described in the context of preferred embodiments, it should be realized that a number of modifications to these teachings may occur to one skilled in the art. As should be appreciated, the scope of the present invention is not limited to a particular configuration of the electronic device. That is, while the present invention has been disclosed above with particular reference to timepieces, one skilled in the art shall now appreciate that the present invention is equally applicable, and as claimed herein, to devices other than timepieces, such as, but not limited to, clocks, thermostats (such as wall mounted thermostats), security devices and other portable electronic devices for use in the home or office. Therefore, reference to a timepiece should equally be understood to refer to at least any of the aforementioned other devices. That is, the present invention construction and methodology are applicable in any electronic device in which a switching mechanism permits selective activation of various modes and states of the device and therefore it would be desirable to track usage thereof.

While the invention has been particularly shown and described with respect to preferred embodiments thereof, it will be understood by those skilled in the art that changes in form and details may be made therein without departing from the scope and spirit of the invention.

What is claimed is:

1. A multi-mode electronic device comprising an integrated circuit that is operable in a plurality of modes, wherein the multi-mode electronic device comprises:

means for detecting the number of times a repeatable event takes place in at least one of the plurality of modes;

means for counting and storing the number of detected occurrences;

means for outputting the number of detected occurrences;

wherein repeatability of the repeatable event is not directly based on any particular user actuation of a switching mechanism of the device.

2. A system for obtaining usage information from a multi-mode electronic device, the system comprising:

an electronic device as claimed in claim 1; and means, operatively coupleable to the electronic device, for receiving the number of detected occurrences outputted by the electronic device and for outputting tern in one of a readable or viewable format.

3. A multi-mode electronic device comprising an integrated circuit that is operable in a plurality of modes, wherein the electronic device comprises:

means for detecting the number of times an event takes place in at least one of the plurality of modes;

means for counting and storing the number of detected occurrences;

means for outputting the number of detected occurrences;

wherein the event occurs only after a predetermined sequence of user activations of a switching mechanism; and wherein the count is not incremented upon each user activation which effectuates the event.

4. A system for obtaining usage information from a multi-mode electronic device, the system comprising:

an electronic device as claimed in claim 3; and means, operatively coupleable to the electronic device, for receiving the number of detected occurrences outputted by the electronic device and for outputting them in one of a readable or viewable format.

5. A multi-mode electronic device comprising:

at least one manually activated switching mechanism;

an integrated circuit coupled to the switching mechanism and operable in a plurality of modes;

means for detecting each activation of the at least one switching mechanism;

means for counting detected activations while the device is in a first operating mode and for counting detected activations while the device is in at least a second operating mode and for storing the number of counted activations while the device is in each of the first and at least second operating modes; and means for outputting the number of counted activations in each of the first and at least second operating modes.

6. A system for obtaining usage information from a multi-mode electronic device, the system comprising:

an electronic device as claimed in claim 5; and means, operatively coupleable to the electronic device, for receiving the number of detected activations outputted by the electronic device and for outputting them in one of a readable or viewable format.

7. A multi-mode electronic device comprising:

an integrated circuit that is operable in a plurality of modes including a mode selecting mode, and wherein from the mode selecting mode each of the plurality of modes is enterable, wherein the integrated circuit has means for cycling among the plurality of modes;

detecting moans for detecting the number of times each of the plurality of modes is entered;

counting means for counting and storing the number of times each of the plurality of modes is entered; and output means for outputting the number of times each of the plurality of modes is entered.

8. The multi-mode electronic device as claimed in claim 7, wherein at least one of the plurality of modes is a multifunctional mode that includes at least two functions each of which is individually accessible, wherein the integrated circuit has means for cycling among the at least two functions in the multifunctional mode;

wherein the detecting means detects the number of times each of the at least two functions are accessed, the counting means counts and stores the number of times each of the am least two of functions are accessed, and the output means outputs the number of times each of the at least two of functions are accessed.

9. A system for obtaining usage information from a multi-mode electronic device, the system comprising:

an electronic device as claimed in claim 7; and means, operatively coupleable to the electronic device, for receiving the number of times each of the plurality of modes is entered outputted by the electronic device and for outputting them in one of a readable or viewable format.

10. A multi-mode electronic device comprising:

a switching mechanism;

an integrated circuit, coupled to the switching mechanism and operable in a plurality of modes, that calculates the cumulative time that the device is operating in each of a plurality of operating modes, wherein the integrated circuit comprises means for storing the cumulative time that the device is operating in each of the plurality of the operating modes, wherein said means are not resettable by a user of said device once the device has left at least one of a factory or retail environment; and an output device for outputting the cumulative time that the device was operating in each of the operating modes.

11. A method for tracking usage time of an electronic device by a user, said electronic device comprising an integrated circuit that is operable in a plurality of modes, the method comprising the steps of:

identifying a selected start time of said electronic device by the user, said selected start time representing a first time that the user performs an identified activation sequence in the electronic device; and tracking the time the electronic device is in operation in a selected mode starting from said selected start time, wherein the time being tacked is stored in a time usage tracking means.

12. The method as claimed in claim 11, wherein the selected start time represents a first time that the user activates one of the plurality of modes of said electronic device; and the time usage tracking means tracks the time the electronic device is in the mode activated by the user starting from said selected start time.

13. The method as claimed in claim 11, including the step of:

outputting the time that the electronic device was in the mode activated by the user starting from the selected start time.

14. The method as claimed in claim 11, wherein the usage of the electronic device in the mode activated by the user is tracked by (i) tracking when the electronic device is in the mode activated by the user and (ii) tracking when the electronic device is not in the mode activated by the user; and increasing the time usage tracking means only when the device is in the mode activated by the user;

wherein the time when the electronic device is in the mode activated by the user is non-continuous.

15. The method as claimed in claim 11, including the step of preventing the user from being able to reset the time usage tracking means.

16. A method for tracking usage time of an electronic device by a user, said electronic device comprising an integrated circuit that is operable in a plurality of modes, the method comprising the steps of:

identifying a selected stan time representing a selected time that the user activates one of the plurality of modes of said electronic device; and tracking the time the electronic device is in an operating mode subsequent to the selected stan time, wherein the time being racked is stored in a time usage tracking means;

wherein the operating mode is a mode different from the mode activated by the user and used to identify the selected start time.

17. The method as claimed in claim 16, including the step of:

outputting the time that the electronic device was in the operating mode starting from the selected stan time.

18. The method as claimed in claim 16, wherein the usage of the electronic device in the operating mode is tracked by (i) tracking when the electronic device is in the operating mode and (ii) when the electronic device is not in the operating mode; and increasing the time usage tracking means only when the device is in the operating mode;

wherein the time when the electronic device is in the operating mode is non-continuous.

19. The method as claimed in claim 16, including the step of preventing the user from being able to reset the time usage tracking means.

* * * * *

UNITED STATES PATENT AND TRADEMARK OFFICE

CERTIFICATE OF CORRECTION

PATENT NO. : 7,187,626 B2
APPLICATION NO. : 10/873827
DATED : March 6, 2007
INVENTOR(S) : Ronald S. Lizzi It is certified that error appears in the above-identified patent and that said Letters Patent is hereby corrected as shown below:

Column 13

Line 27, delete “the am least” and replace it with --the at least--

Column 14

Line 33, delete “selected stan time” and replace it with --selected start time--
Line 37, delete “selected stan time” and replace it with --selected start time--
Line 47, delete “selected stan time” and replace it with --selected start time--

Signed and Sealed this

Eighth Day of May, 2007

JON W. DUDAS
*Director of the United States Patent and Trademark Office*